US006430385B1

(12) United States Patent
Hanselman et al.

(10) Patent No.: US 6,430,385 B1
(45) Date of Patent: Aug. 6, 2002

(54) WICK ROLLER ASSEMBLY FOR AN ELECTROPHOTOGRAPHIC MACHINE

(75) Inventors: James F. Hanselman, Pittsford; David F. Cahill, Rochester; Terry N. Morganti, Brockport, all of NY (US)

(73) Assignee: Heidelberger Druckmaschinen, Heidelberg (DE)

( * ) Notice: Subject to any disclaimer, the term of this patent is extended or adjusted under 35 U.S.C. 154(b) by 0 days.

(21) Appl. No.: 09/745,861

(22) Filed: Dec. 21, 2000

(51) Int. Cl.[7] ..... G03G 21/00
(52) U.S. Cl. ..... 399/325
(58) Field of Search ..... 399/324, 325, 399/326, 327

(56) References Cited

U.S. PATENT DOCUMENTS 4,501,483 A 2/1985 Romansky et al. ..... 399/325
4,899,197 A * 2/1990 Davis et al. ..... 399/326
5,327,204 A * 7/1994 Sculley et al. ..... 399/325
5,389,958 A 2/1995 Bui et al. ..... 347/103
5,477,316 A 12/1995 Morganti et al. ..... 399/324
5,534,986 A * 7/1996 Irro et al. ..... 399/325
5,781,840 A 7/1998 Chen et al. ..... 399/324
5,805,968 A 9/1998 Chatterjee et al. ..... 399/324
5,824,416 A 10/1998 Chen et al. ..... 428/422
5,852,761 A * 12/1998 Marcelletti et al. ..... 399/325
5,871,878 A 2/1999 Chatterjee et al. ..... 430/105

* cited by examiner

*Primary Examiner*—Sophia S. Chen
*Assistant Examiner*—Hoan Tran

(57) ABSTRACT

An electrophotographic apparatus having a wick roller assembly and a method for servicing. The wick roller assembly is rotatably mounted to the fuser section of the apparatus and is releasably latched thereto whereby the fuser roller in the assembly can be quickly and easily accessed for servicing. This eliminates the need for a technician to remove the entire wick roller assembly in order to service or replace the wick roller, itself.

10 Claims, 3 Drawing Sheets

WICK ROLLER ASSEMBLY FOR AN ELECTROPHOTOGRAPHIC MACHINE

FIELD OF THE INVENTION

The present invention relates to a wick roller assembly for use in the fuser section of a electrophotographic copier/printer apparatus and in one of its aspects relates to an assembly for mounting the wick roller in the fuser section of an electrophotographic apparatus which allows the wick roller to be easily and quickly serviced and/or replaced from outside the fuser section housing.

BACKGROUND OF THE INVENTION

In a typical electrophotographic machine (e.g. copier, duplicators, printers, etc.), a continuous loop of photoconductor film is commonly used to transfer an image from an input section onto a receiving medium (e.g. a sheet of paper). The film is initially charged and then passes through an input section where an image (i.e. analog or digital) is projected onto the charged film. The film then moves through a developing section where a toner is applied to the charged image, and on through an image transfer section where the image is transferred to the sheet of paper or other medium. The paper is subsequently passed through a fuser section where the toner forming the image is fixed to the paper by elevated temperature and pressure. This is typically accomplished by passing the paper between two, opposed rollers, i.e. a pressure roller and a fuser roller, one of which is heated.

A known problem in fuser sections of this type is the that of "offset" which results when some of the heat-softened toner particles adhere to surface of the fuser roller and are not transferred to the paper or other medium as desired. As well understood in the art, this toner offset can severely affect the quality of the copies being made by the machine. One known method for alleviating this problem is to apply a silicone or the like release fluid or oil (hereinafter referred to a "release oil") onto the fuser roller to prevent the toner from sticking thereto.

To apply this release oil onto the fuser roller, it is common to use a rotating wick, i.e. "wick roller". A typical wick roller is comprised of a cylindrical core which is covered with a layer of a high temperature wicking material (e.g. a fabric such as porous felt or the like) which, in turn, is permeated with the release oil. The wick roller is mounted on movable brackets within the fuser section substantially parallel to the fuser roller and is moved into and out of contact therewith by a cam shaft or the like so that the release oil is applied to the fuser roller at timed intervals during the copying operation.

As release oil is used from the wick material, it must be replenished in order to sustain the operational life of the fuser section. Typically, this oil is supplied through a thin conduit having openings along its length through which the oil is distributed evenly within the wicking layer. This conduit is rigid enough to support its own weight within the wick roller and is attached to a oil supply tube which supplies the release oil to the perforated conduit within the wick roller. While the replenishing of the release oil to the wick roller significantly extends the service life of the wick roller, the wick roller will, nevertheless, eventually become dirty and/or worn-out and will have to be replaced.

Unfortunately however, since the wick roller is mounted inside the fuser section and is secured in place by a plurality of screws or the like which sometimes are hard to access, it is difficult and time consuming for a service technician to remove and replace this roller. Further, the natural inclination of a technician is to grasp and use the oil supply conduit to pull the wick roller out of its brackets which, in turn, is likely to cause the tube to bend, thereby requiring replacement of the tube. As will be recognized, this substantially adds to the time and the cost involved in servicing the wick roller.

As will be appreciated by those who depend on electrophotographic machine(s) in their commercial operations, time is normally of the essence. Therefore, it is imperative that downtime of the machine be kept to a minimum and that all maintenance/service operations be performed in as short of time as possible. Further, to keep maintenance/service costs down, the more frequently required maintenance operations should be capable of being carried out by a single service person with a minimum of special tools, if any. In some cases, if the maintenance/service operations are simple enough, the owner or user of the machine may train an employee to carry out such operations without requiring the services of an outside contractor.

Accordingly, it is desirable to provide ready access to the wick roller so that it can easily and quickly be removed and replaced within the fuser housing by a single technician thereby keeping service costs and downtime for the machine to a minimum.

SUMMARY OF THE INVENTION

The present invention provides an electrophotographic apparatus and a method for servicing. The apparatus includes a wick roller assembly which forms a part of the fuser section of the apparatus. Basically, the wick roller assembly is rotatably mounted in the housing of the fuser section and is releasably latched thereto whereby the fuser roller in the assembly can be quickly and easily accessed for servicing. This eliminates the need for a technician to remove the entire wick roller assembly in order to service or replace the wick roller, itself.

More specifically, the present invention relates to an electrophotographic apparatus having a fuser section which, in turn, includes a wick roller assembly. The frame of wick roller assembly is connected to the housing of the fuser section by a pivot connection so that the wick roller assembly can be rotated outward from the housing without removing said the roller assembly from the housing. This pivot connection is formed by a plurality of spaced tabs extending from the bottom of the frame which are received into a plurality of spaced slots which are formed across the bottom of said housing.

A releasable latch mechanism is provided on the frame of the wick roller assembly for securing the wick roller assembly in its operable position within said housing. The latch mechanism is comprised of an elongated bar which is slidably mounted on the frame of the wick roller assembly. The bar has a pair of keyhole-shaped openings therein, one near either end thereof. The keyhole-shaped openings are adapted to receive a respective one latch pin which, in turn, is at a respective side of the housing of the fuser section. A handle is rotatably mounted on the frame for moving said bar laterally whereby the slotted portion of a keyhole-shaped opening moves behind the head of a respective latch pin to latch the frame of the wick roller assembly to the housing of the fuser section.

A handle is provided on the frame to move the latch bar between the latched and said unlatched positions. A lock element is passed through the frame and is threaded into said housing to secure the frame to the housing to prevent unintentional rotation of the frame with respect to the housing. A removable cover is releasably secured over the wick roller assembly when the wick roller assembly is in said latched position within said housing to protect the assembly and to further prevent the unintentionally unlatching of same.

From the above, it can be seen that the wick roller within the wick roller assembly can quickly and easily be serviced by removing the cover, unlatching the wick roller assembly from the housing of the fuser section, and then rotating the assembly away from the housing without having to remove the entire wick roller assembly. This exposes the wick roller which is resting between two open brackets within the frame of the assembly from which the wick roller can be easily removed. The wick roller can be then serviced and/or replaced into the brackets within the wick roller assembly. The assembly is then rotating back towards the housing and the latch mechanism is then returned to its latched position.

BRIEF DESCRIPTION OF THE DRAWINGS

The actual construction operation, and apparent advantages of the present invention will be better understood by referring to the drawings, not necessarily to scale, in which like numerals identify like parts and in which.

DESCRIPTION OF THE PREFERRED EMBODIMENT

Figure 1:
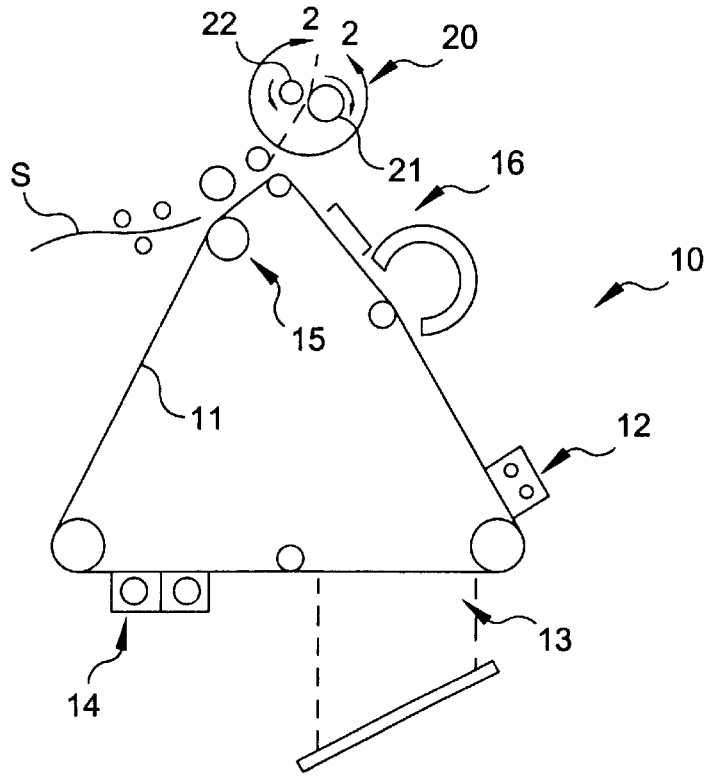
FIG. 1 is a schematic view of an electrophotographic apparatus (e.g. copier/printer machine) in which the present invention can be incorporated.

Referring briefly to FIG. 1, a typical electrophotographic apparatus or machine 10 (e.g. copier, duplicator, printer) of the kind that has an endless photoconductor member 11 (e.g. photographic film) which moves through a closed loop past a charging station 12, a an exposure or input station 13, a developing station 14, a transfer station 14, and an erase/clean section 16. A copy medium (e.g. a sheet S of paper) is fed from a supply (not shown) through transfer station 15 where the toner image on the film 11 is transferred to the paper S. The paper S is then fed between a fusing roller 21 and a pressure roller 22 in fuser section 20 to fix the toner image on the paper S before the paper exits the machine.

Figure 2:
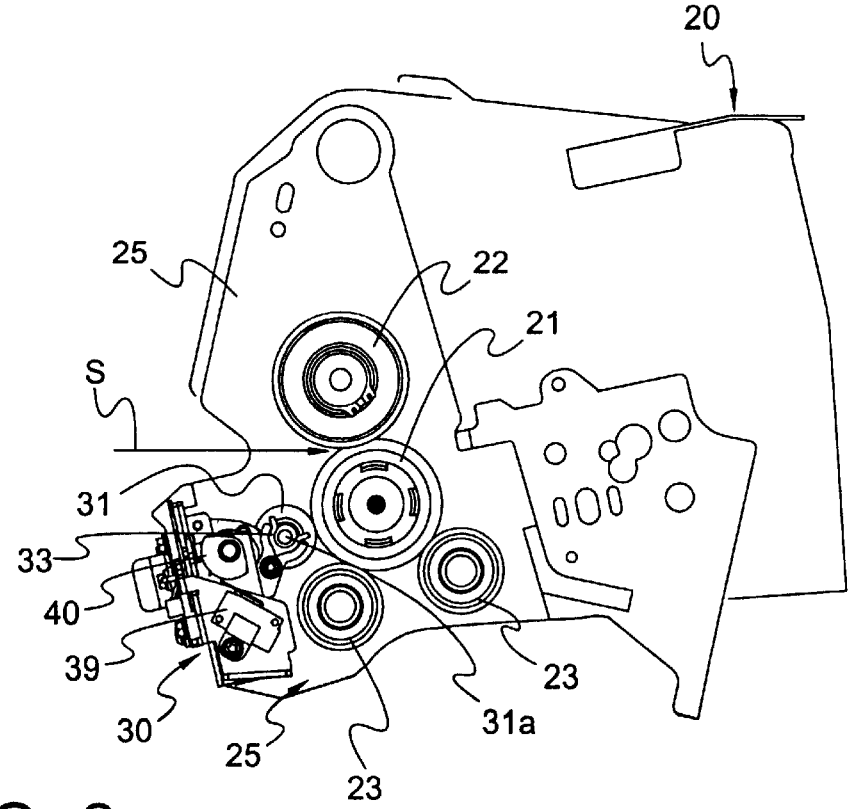
FIG. 2 is a cross-section view of a fuser section such as that lying within line 2—2 of FIG. 1 having the wick roller assembly of the present invention incorporated thereon.
Figure 3:
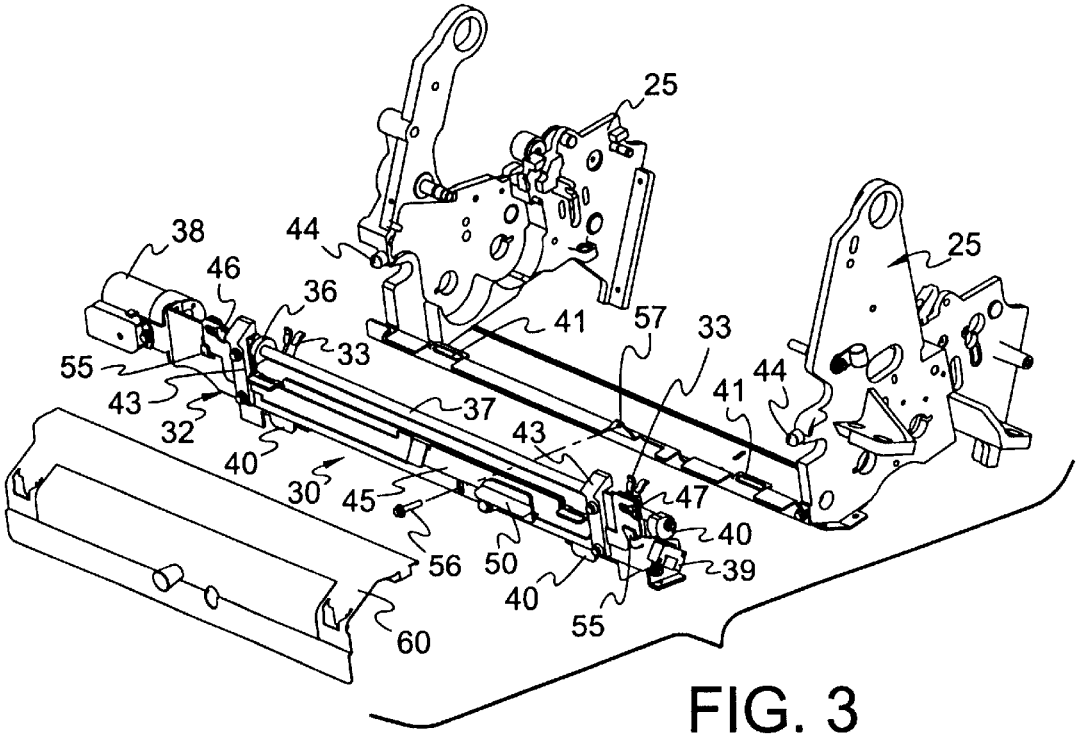
FIG. 3 is an exploded, perspective view of the wick roller assembly of FIG. 2 and a portion of the fuser section housing.
Figure 4:
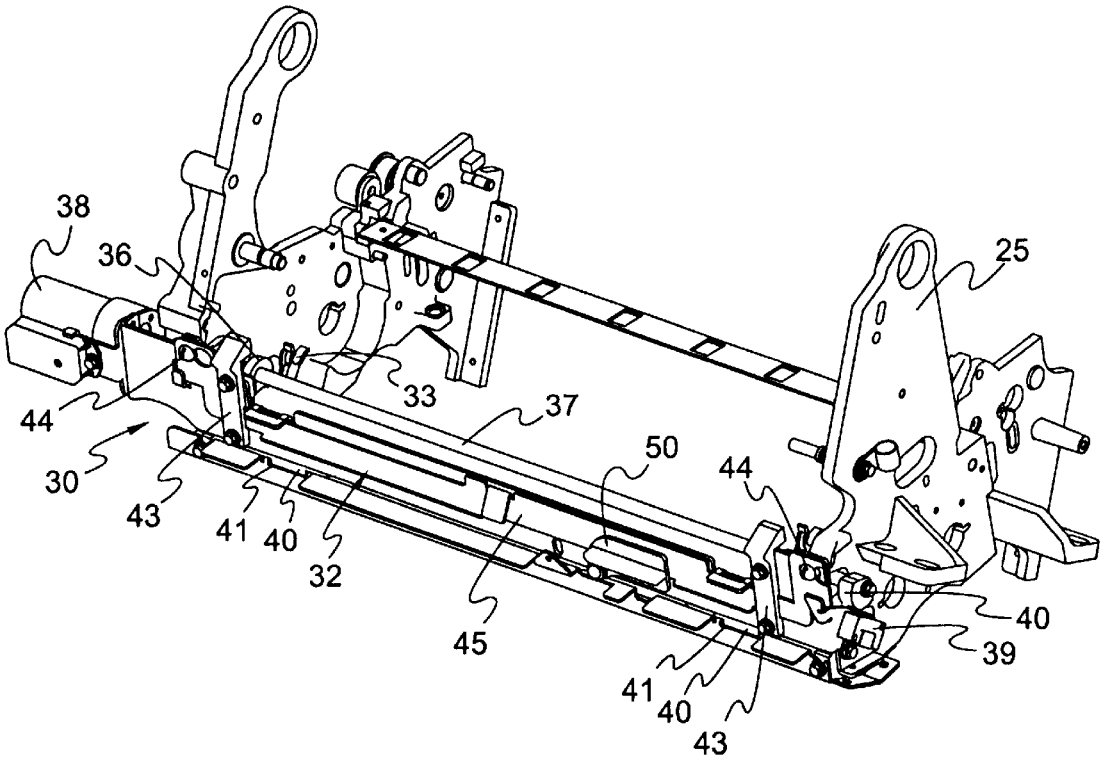
FIG. 4 is a perspective view of the wick roller assembly and the fuser section housing in an assembled position.
Figure 5:
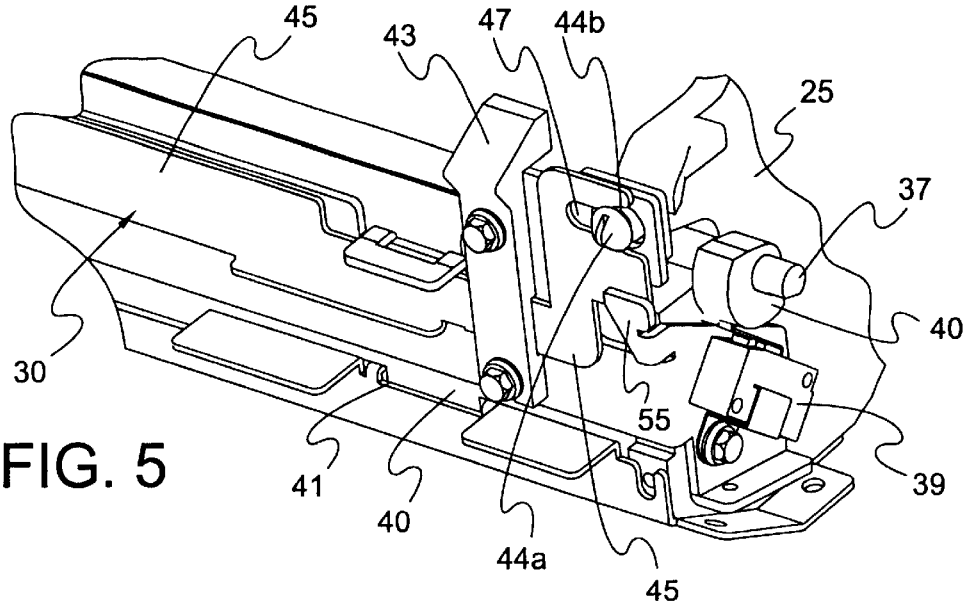
FIG. 5 is an enlarged, perspective view, partly broken-away, of one end of the wick roller assembly and housing of FIG. 4.

FIG. 2 is a cross-sectional view of a typical fuser section 20 which might be found in the electrophotographic machine 10 of FIG. 1. As illustrated, fuser section 20 is comprised of a frame or housing 25 in which pressure roller 22, fuser roller 21, and two heating rollers 23 are rotatably mounted. Also, positioned with housing 25 is wick roller assembly 30 which will be described in detail below. As will be appreciated, housing 25 is also filled with a sophisticated maze of electrical and mechanical components (not shown for clarity) which crowd and congest the inside of housing 25 and which can make the servicing of the various components difficult.

As will be understood in the art, a motor (not shown) mounted on the housing 25 rotates pressure roller 22 which, in turn, rotates fuser roller 21 through the frictional contact therebetween. Fuser roller 21 is heated by heating rollers 23 so that when the sheet of paper S or the like passes through the nip between rollers 21, 22, the heat and pressure exerted thereby will cause the toner carried on S to become fused on the paper. In fusers of this type, some of the toner particles are likely to adhere to fuser roller (i.e. "toner offset") which can severely affect the quality of the copies being made unless remedies are taken to correct this problem.

One such remedy is to apply a release oil directly onto the fuser roller 21 during copying operations which is applied through a wick roller assembly such as wick roller assembly 30 shown in FIG. 2. In prior art machines of this type, this wick roller assembly, is typically secured within the fuser section by a plurality of screws or the like which sometimes are not readily or easily accessible. This makes the servicing of the wick roller difficult and time consuming. The present invention provides a wick roller assembly which allows the wick roller therein to be accessed and serviced with a minimum of difficulty and down time.

Wick roller assembly 30 of the present invention has a wick roller 31 rotatably mounted therein. Since the basic construction of wick roller 31, itself, is basically the same as those used in prior, known fuser sections of this type, the details of wick roller are not shown in the present figures for the sake of clarity. Basically, wick rollers of this type are comprised of a cylindrical core covered with a layer of wicking material, e.g. fabric such as high temperature felt. A perforated conduit or tube (not shown) is mounted within the core of the roller to distribute the release oil (e.g. a silicone oil or the like) along the length of the roller and into the layer of wick material on the roller. A supply tube (not shown) supplies additional oil to the perforated conduit as needed. When the roller is moved into contact with the fuser roller, oil is transferred from the wicking material onto the fuser roller as will be understood in the art.

Referring now to FIGS. 3–7, wick roller assembly 30 of the present invention will now be described. As illustrated in these figures, fuser roller 21, pressure roller 22, heating rollers 23, and wick roller 31 (shown in FIG. 2) have all been removed and are not shown in these figures for the sake of clarity. Wick roller assembly 30 is comprised of a frame 32 having a pair of spaced brackets 33 therein, one at either side of frame 32. The ends of axle 31*a* (FIG. 2) of wick roller 31 merely rest in their respective brackets 33 whereby roller 31 can freely rotate with respect thereto. Brackets 33 are pivotably mounted within frame 32 whereby wick roller 31 can be moved into and out of contact with fuser roller 21 when brackets 33 are pivoted towards their operable position.

Normally, brackets 33 are biased outward toward fuser roller 21 by springs (not shown) so that wick roller 31 will be in contact with the fuser roller during the fusing operation. Cams 36 (FIGS. 3 and 4) on shaft 37, which, in turn, is jounalled in frame 32, cooperate with respective brackets 33 to move the brackets 33, hence wick roller 31, away from contact with the fuser roller 21 during idle periods. A motor 38, controlled by a cam (40)-operated switch 39, is mounted on frame 32 and rotates shaft 37 and cams 36 to move wick roller 21 into and out of contact with fuser roller 21 as will be understood in the art.

Frame 32 has a plurality of tabs 40 (two shown) spaced across the bottom thereof which are adapted to align with and slide into a like number of respective slots 41 which are formed across the bottom of fuser housing 25. The cooperation between tabs 40 and slots 41 not only stabilizes wick roller assembly 30 within housing 25 but it also provides a releasable, pivot connection between the two components. That is, as long as the tabs 40 are in slots 41, assembly 30 can be rotated about this pivot connection to provide easy access to wick roller 31 without having to remove assembly 30 from the housing. Of course, assembly 30 can be easily and completely removed from housing 25, if desired, by merely disconnecting any electrical connections (not shown) and lifting the tabs 40 out of slots 41.

To secure wick roller assembly 31 in its operable position within housing 25, a releasable latch mechanism is provided on frame 32 which cooperates with latch pins 44 which, in turn, are affixed at either side of the back of housing 25 near the top thereof. These latch pins have a reduced diameter shaft portion 44*b* and a larger diameter head 44*a* (see FIG. 5). The latch mechanism comprises a latch bar 45 which extends across the back of frame 32 and is slidably secured to the frame by guides 43; i.e. bar 45 freely extends through recesses in the guides whereby the bar can easily slide relative to guides 43 for a purpose described below.

Latch bar 45 has a latch opening 46, 47 at either end thereof. Latch openings 46, 47 are similar to each other in that both are formed by a keyhole slot which has a first portion large enough to receive the head of a pin 44 and a slot contiguous therewith having a width slightly larger than the shaft of pin but smaller than the head of the pin. Latch opening 47 may differ from latch opening 46 wherein its outer end may be open as shown to facilitate the positioning of pins 44 within their respective latch openings but both latch openings can be closed without departing from the present invention.

To assemble wick roller assembly 30 into fuser housing 25, tabs 40 are positioned into slots 41 and latch openings 46, 47 are positioned over their respective pins 44. Initially, the heads 44*a* of pins 44 will be received within the large diameter portions of the respective latch openings 46, 47. Latch bar 45 is then moved laterally (i.e. to the right as viewed in the figures) to move the contiguous slots portions of latch openings 46, 47 onto the shafts 44*b* of pins 44 and in behind the heads 44*a* thereof. As will be understood, this latching sequence will secure wick assembly 30 in its operable position within fuser housing 25. For additional support for the latch bar 45, tabs 55 (FIGS. 3 and 5) are provided on frame 32 at either end of the bar. These tabs prevent the bending of bar 45 if someone attempts to rotate assembly 30 while bar 45 is not fully open.

Figure 6:
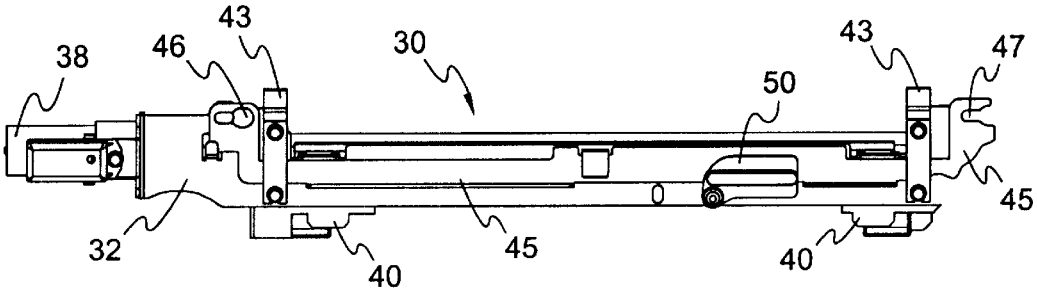
FIG. 6 is a side view of the wick roller assembly of FIG. 3.
Figure 7:
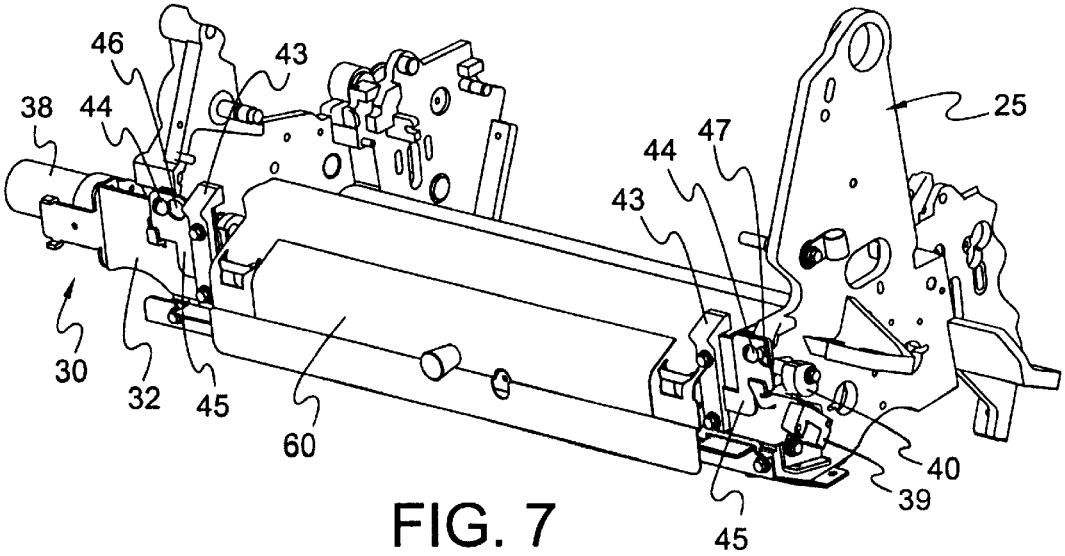
FIG. 7 is a perspective view similar to FIG. 4 showing the cover of FIG. 3 in an assembled position.

To facilitate the lateral movement of the latch bar 32 with respect to housing 25, a handle 50 is rotatably mounted on frame 32 and is movable between its unlatched position (dotted lines in FIG. 6) and its latched position (solid lines in FIG. 6). As the handle rotates, it engages a dowel pin or the like on the latch bar 45 (not shown) to thereby move the latch bar 45 between the latched and unlatched positions, as the case may be. Since assembly 30 can be unlatched by merely rotating handle 50 from its latched position, a technician needs to make no hand contact with surfaces surrounding the assembly and housing 25, which are likely to be at high temperature. Also, to further guard against a technician accidentally burning himself while unlatching the wick roller assembly 30, handle 50 is preferably made of a heat-insulative material, e.g. plastic or the like.

Once wick roller assembly 30 is latched in its operable position, a lock element (e.g. a single screw 56 or the like) can be passed through the frame 32 and into a threaded receptacle 57 on housing 25 (FIG. 3) to prevent unintentionally removal of assembly 30 even if latch bar 45 is accidentally unlatched. After screw 56 is in place, a cover 60 (FIG. 3) is then placed over the latched wick roller assembly 30 (FIG. 7) to protect the assembly and to further insure against unintentional access to the wick roller assembly. Preferably, this cover is a "snap-on" type which can be easily removed and replaced, as will be understood in the art. Preferably, cover 60 is designed so that it can not be installed if handle 50 is not in its fully latched position.

To service the wick roller assembly 30, the above procedure is merely reversed. Cover 60 and screw 56 are removed. Handle 50 is rotated to its unlatched position which moves latch bar 45 laterally to thereby align the large diameter portions of latch openings 46, 47 with heads 44*a* of latch pins 44. Assembly 30 can then be rotated about the pivot connection formed between tabs 40 and slots 41 and wick roller 31 can be merely lifted straight out of brackets 33 for servicing. If further servicing is required, any electrical leads are disconnected and the entire wick roller assembly 30 is merely lifted out.

It should be evident from the above that the wick roller assembly 30 can be serviced or replaced, easily and quickly, by a single technician without the need for any special tools or assistance. This is very important in reducing the costs and the down time normally associated with machines of this type.

What is claimed is:

1. An electrophotographic apparatus having a fuser section, said fuser section comprising:

a housing having two sides and a bottom;

a wick roller assembly;

a pivot connection for pivotably mounting said wick roller assembly in said housing whereby said wick roller assembly can be rotated with respect to said housing without removing said wick roller assembly from said housing; and a releasable latch mechanism for securing said wick roller assembly against rotation when said wick roller assembly is in an operable position within said housing.

2. The electrophotographic apparatus of claim 1 wherein said wick roller assembly comprises:

a frame having two sides and a bottom;

a wick roller having an axle, said wick roller being rotatably mounted within said frame;

and wherein said pivot connection comprises:

a plurality of spaced tabs attached to and extending from the bottom of said frame; and a plurality of spaced slots formed across the bottom of said housing wherein each of said spaced slots on said housing is adapted to removably receive a respective tab on said frame whereby said frame can rotate with respect to said housing or can be completely removed therefrom.

3. The electrophotographic apparatus of claim 2 wherein said plurality of said spaced tabs comprises:

two tabs, one of said tabs being affixed to said bottom of said frame near each of said respective sides of said frame;

and wherein said plurality of said spaced slots comprises:

two slots, one of said slots being formed in said bottom of said housing near each of said respective sides of said housing whereby said two tabs on said frame will align and be received by said respective two slots on said housing.

4. The electrophotographic apparatus of claim 2 wherein said wick roller assembly further comprises:

a pair of brackets, one of said pair of said brackets being pivotably mounted at a respective side of said frame, each of said brackets being open to receive a respective end of said wick roller axle whereby said wick roller can be freely placed and removed from said brackets.

5. The electrophotographic apparatus of claim 4 wherein said housing further comprises:

a pair of latch pins, one of said latch pins affixed at a respective side of said housing;

and wherein said releasable latch mechanism comprises: an elongated bar slidably mounted on said frame and adapted to engage said pair of latch pins when in a latched position and to disengage from said latch pins when in an unlatched position.

6. The electrophotographic apparatus of claim 5 wherein said bar comprises:

a pair of keyhole-shaped openings therein, one of said keyhole-shaped openings formed near a respective end of said bar, each keyhole-shaped opening adapted to receive a respective one of said pair of said latch pins.

7. The electrophotographic apparatus of claim 6 wherein said releasable latch mechanism further comprises:

a handle rotatably mounted on said frame for moving said bar between said latched position and said unlatched position.

8. The electrophotographic apparatus of claim 7 further comprising:

a lock element passing through said frame and into said housing to secure said frame to said housing when said latch mechanism is in said latched position to thereby prevent unintentional rotation of said frame with respect to said housing.

9. The electrophotographic apparatus of claim 8 wherein said lock element is threaded into said housing.

10. The electrophotographic apparatus of claim 5 including:

a removable cover releasably secured over said wick roller assembly when said wick roller assembly is in said latched position within said housing.

* * * * *